US011884365B1

(12) United States Patent
Duffy-Protentis

(10) Patent No.: US 11,884,365 B1
(45) Date of Patent: Jan. 30, 2024

(54) METHOD AND APPARATUS FOR DRAINAGE OF WATER FROM AN ELECTRIC WATERCRAFT

(71) Applicant: JaccPro, LLC, Easton, MA (US)

(72) Inventor: Jack Patrick Duffy-Protentis, Worcester, MA (US)

(73) Assignee: JaccPro, LLC, Easton, MA (US)

( * ) Notice: Subject to any disclaimer, the term of this patent is extended or adjusted under 35 U.S.C. 154(b) by 0 days.

(21) Appl. No.: 17/900,053

(22) Filed: Aug. 31, 2022

(51) Int. Cl.

| | |
|---|---|
| ***B63B 13/00*** | (2006.01) |
| ***B63B 49/00*** | (2006.01) |
| ***B63H 11/08*** | (2006.01) |
| ***B63B 34/10*** | (2020.01) |

(52) U.S. Cl.
CPC ..... *B63B 13/00* (2013.01); *B63B 34/10* (2020.02); *B63B 49/00* (2013.01); *B63H 11/08* (2013.01)

(58) Field of Classification Search
CPC ..... B63B 13/00; B63B 34/00; B63B 34/10; B63B 49/00; B63H 11/00; B63H 11/08
USPC ..... 114/55.51
See application file for complete search history.

(56) References Cited

U.S. PATENT DOCUMENTS

| | | | | |
|---|---|---|---|---|
| 6,553,928 | B2 | 4/2003 | Yamada | |
| 6,890,224 | B2 * | 5/2005 | McCann | B63B 34/10 114/55.5 |
| 7,341,015 | B2 * | 3/2008 | Bourret | B63B 13/00 114/183 R |
| 7,617,789 | B2 | 11/2009 | Simard | |
| 10,926,845 | B2 | 2/2021 | Schmidt | |
| 2021/0284308 | A1 | 9/2021 | Schmidt | |

FOREIGN PATENT DOCUMENTS

| | | | |
|---|---|---|---|
| CN | 107344595 | A1 | 11/2017 |

* cited by examiner

*Primary Examiner* — Lars A Olson
(74) *Attorney, Agent, or Firm* — Caldwell Intellectual Property Law

(57) ABSTRACT

An electric watercraft, wherein the electric watercraft includes at least an electric propulsor configured to propel the electric watercraft in a fluid. Electric watercraft further include a plurality of battery packs located beneath a deck of the electric watercraft and configured to poser the at least an electric propulsor. Electric watercraft further include at least a drainage system configured to drain fluid from the deck, wherein the at least a drainage system further includes at least a drainage path having a drainage path inlet and a drainage path outlet, and the deck and the drainage path inlet are configured to flow fluid from a top side of the deck of the electric watercraft.

16 Claims, 6 Drawing Sheets

METHOD AND APPARATUS FOR DRAINAGE OF WATER FROM AN ELECTRIC WATERCRAFT

FIELD OF THE INVENTION

The present invention generally relates to the field of electric watercraft. In particular, the present invention is directed to method and apparatus for drainage of water from an electric watercraft.

BACKGROUND

Electric watercraft may be especially averse to water that is allowed to pool on deck. Additionally, electric watercraft and its driver/passengers may also be at risk when water flows inside of the watercraft.

SUMMARY OF THE DISCLOSURE

In an aspect the present disclosure is directed to an electric watercraft, wherein the electric watercraft includes at least an electric propulsor configured to propel the electric watercraft in a fluid. Electric watercraft further include a plurality of battery packs located beneath a deck of the electric watercraft and configured to power the at least an electric propulsor. Electric watercraft further include at least a drainage system configured to drain fluid from the deck, wherein the at least a drainage system further includes at least a drainage path having a drainage path inlet and a drainage path outlet, and the deck and the drainage path inlet are configured to flow fluid from a top side of the deck of the electric watercraft.

In another aspect, a method for drainage of water from an electric watercraft is shown, the method includes propelling, using an electric propulsor, the electric watercraft in a fluid. The method further includes powering, using a battery pack located beneath a deck of the electric watercraft, the electric propulsor. The method further includes draining, using at least a drainage system, a fluid from the deck, wherein the at least a drainage system further includes at least a drainage path having a drainage path inlet and a drainage path outlet, and the deck and the drainage path inlet are configured to flow fluid from a top side of the deck of the electric watercraft.

These and other aspects and features of non-limiting embodiments of the present invention will become apparent to those skilled in the art upon review of the following description of specific non-limiting embodiments of the invention in conjunction with the accompanying drawings.

For the purpose of illustrating the invention, the drawings show aspects of one or more embodiments of the invention. However, it should be understood that the present invention is not limited to the precise arrangements and instrumentalities shown in the drawings, wherein:

FIG. 1 is a diagram of an exemplary embodiment of an electric watercraft;

FIG. 2 is a block diagram of an exemplary embodiment of a passive drainage of a drainage system;

FIG. 3 is a block diagram of an exemplary embodiment of an active drainage of a drainage system;

FIG. 4 is an illustration of an exploded view of an electric motor in the electric watercraft;

FIG. 5 is flow diagram of an exemplary method of drainage of water from an electric watercraft; and FIG. 6 is a block diagram of a computing system that can be used to implement any one or more of the methodologies disclosed herein and any one or more portions thereof.

The drawings are not necessarily to scale and may be illustrated by phantom lines, diagrammatic representations and fragmentary views. In certain instances, details that are not necessary for an understanding of the embodiments or that render other details difficult to perceive may have been omitted.

BRIEF DESCRIPTION OF THE DRAWINGS

At high level, aspect of the present disclosure is directed to an electric watercraft, wherein the electric watercraft includes at least an electric propulsor configured to propel the electric watercraft in a fluid. Electric watercraft further include a plurality of battery packs located beneath a deck of the electric watercraft and configured to power the at least an electric propulsor. Electric watercraft further include at least a drainage system configured to drain fluid from the deck, wherein the at least a drainage system further includes at least a drainage path having a drainage path inlet and a drainage path outlet, and the deck and the drainage path inlet are configured to flow fluid from a top side of the deck of the electric watercraft.

Now referring to FIG. 1, an exemplary embodiment of an electric watercraft 100 is illustrated. An "electric watercraft," as used in this disclosure, is a vehicle used in or on water that is powered by electricity. The electric watercraft 100 may include any marine vehicle. For example, electric watercraft may include boats, hovercraft, personal watercraft (PWC), unmanned watercraft, submarines, and the like. In some cases, electric watercraft 100 may be a sit-down watercraft. As used in this disclosure, a sit-down watercraft is a watercraft where the rider of the watercraft uses the watercraft mainly sitting down. In other cases, electric watercraft 100 may also be a stand-up watercraft. As used in this disclosure, a stand-up watercraft is a watercraft where the rider of the watercraft uses the watercraft standing up. The electric watercraft 100 may include a hull 104, wherein a plurality of parts resides in or on the hull such as battery and motor. The electric watercraft 100 may include a deck 108. Deck 108 is a covering that sits on top of the hull 104. In some cases, deck 108 may provide support for the driver/passengers. In an embodiment, electric watercraft 100 may include at least a passenger seat 112 located on a deck. In some cases, watercraft may include a plurality of passenger seats 112. In some cases, each passenger seat of a plurality of passenger seats 112 may be designed to fit one passenger. In some embodiments, passenger seat 112 may include a seating surface. Seating surface may be at a certain angle with deck 108. In some cases, seating surface of passenger seat 112 may be in parallel with deck 108. In another embodiment, electric watercraft 100 may not include any passenger seat 112 on the deck. In a non-limited example, electric watercraft 100 may be an electrically powered jet-propelled personal watercraft with two passenger seats 112, wherein each passenger seat 112 may include a seating surface at a 5, 10, 20, 30, or 40 degree angle to deck 108.

Figure 1:
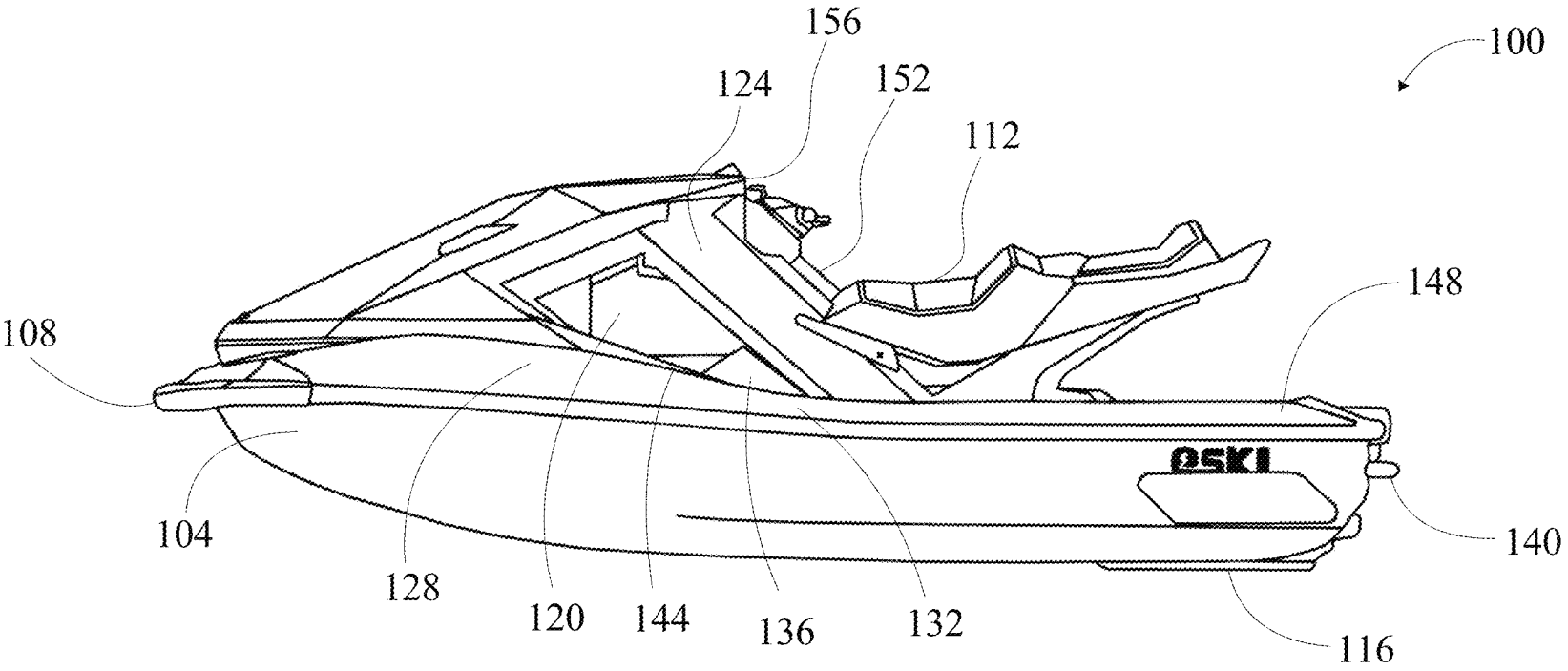

With continued reference to FIG. 1, electric watercraft 100 include at least an electric propulsor 116 configured to propel the electric watercraft 100 in a fluid. As used in this disclosure, an "electric propulsor" is a component, powered by electricity, used to propel a vehicle by exerting force on a fluid medium which may include a gaseous medium such as air or a liquid medium such as water. In some embodiments, electric propulsor 116 may be located internally to hull 104 of electric watercraft 100. In other embodiments, the electric propulsor 116 may be located externally to hull 104 of electric watercraft 100 and may be in contact with the fluid. For instance, electric propulsor 116 may be an impeller. In an embodiment, electric watercraft 100 may include an electric motor 120. As used in this disclosure, an "electric motor" is any machine that converts electrical energy into mechanical energy. Electric motor 120 may be driven by direct current (DC) electric power and may include, without limitation, brushless DC electric motors, switched reluctance motors, induction motors, or any combination thereof. Electric motor 120 may also include electronic speed controllers or other components for regulating motor speed, rotation direction, and/or dynamic braking. As used in this disclosure, a "motor" is any machine that converts non-mechanical energy into mechanical energy. Electric motor 120 will be disclosed in further detail below.

With continued reference to FIG. 1, electric watercraft may be powered by a plurality of battery packs 124. A "battery pack," as used in this disclosure, is a set of a plurality of battery cells. In some cases, plurality of battery packs 124 may be configured in series, parallel, or a mixture of both to deliver certain voltage, capacity, and/or power density. Each battery pack of plurality of battery packs 124 may contain at least an electric conductor. In some cases, plurality of battery packs 124 may include a plurality of electric conductors. Each electric conductor may provide electrical conductivity between one or more batteries or battery cells within battery pack. An "electric conductor," as used in this disclosure, is an object or type of material that conducts a flow of charge or electric current. Exemplary battery cells in battery pack 124 may include, lithium-ion battery cells, lithium-metal battery cells, air-metal battery cells, lead-acid battery cells, or the like. In some embodiment, battery pack 124 may include a battery regulator. As described in this disclosure, a "battery regulator" is an electric device in a battery pack that performs battery regulation or redistribution. As used in this disclosure, "battery regulation" or "battery redistribution" refers to a process that keep voltage of each individual cell below its maximum value during operation, non-operation, or charging. In some embodiment, battery pack 124 may include a battery balancer. As described herein, a "battery balancer" is an electric device in the battery pack that performs battery balancing. As used in this disclosure, "battery balancing" refers to a process that balances electric energy from one or more first battery cells (e.g., strong battery cells) to one or more second battery cells (e.g., weaker battery cells). Battery pack 124 may be an inline package, wherein a plurality of battery cells is selected and stacked with solder in between them.

With continued reference to FIG. 1, in an embodiment, battery pack 112 may be an absorbent glass mat (AGM) battery. As used in this disclosure, an "absorbent glass mat battery" is a type of a valve regulated lead-acid (VRLA) battery. In some cases, valve regulated lead-acid battery may limit amount of electrolyte absorbed in a plate separator, wherein the plate separator may include a positive plate and a negative plate which facilitate oxygen recombination within battery cell. In an embodiment, valve regulated lead-acid battery may further form absorbed electrolyte into a gel. In another embodiment, valve regulated lead-acid battery may include a relief valve, wherein the relief valve may retain plurality of components within valve regulated lead-acid battery in independent positions. In some embodiments, absorbent glass mat battery may include a fiberglass mesh, wherein the fiberglass mesh may be placed between positive plate and negative plate. In some cases, fiberglass mesh may include electrolyte and separate positive plate and negative plate. Further, Positive plate and/or negative plate may be in any shape such as, without limitation, flat, bent, rolled, and the like thereof. In some embodiments, absorbent glass mat battery may be mounted in any orientation. Additionally, or alternatively, absorbent glass mat battery maybe maintenance-free. As used in this disclosure, "maintenance-free" means no constant maintenance required, but cleaning and/or regular function testing is still required. In other embodiments, absorbent glass mat battery may resist self-discharging within a wide range of temperatures.

With continued reference to FIG. 1, electric watercraft 100 include at least a drainage system 128. As used in this disclosure, a "drainage system" is a system that naturally and/or artificially remove fluid on a surface or a sub-surface from an area with excess of fluid. In some cases, surface or sub-surface may be deck 108 of electric watercraft 100. In some embodiments, drainage system 128 may be located internally to electric watercraft 100. In a non-limiting example, drainage system 128 may be located inside hull 104 beneath deck 108 of electric watercraft 100. Drainage system 128 further include at least a drainage path 132. As used in this disclosure, a "drainage path" is a component that serves as a pathway for flowing fluid, directing flowing fluid from a first point to a second point. In some embodiments, drainage path 132 may be a pipe that traverse along and/or through the body of electric watercraft 100. For instance, drainage path 132 may traverse through hull 104 of electric watercraft 100. In some embodiments, drainage system 128 may include a plurality of drainage paths. Further, drainage path 132 include at least a drainage path inlet 136 and a drainage path outlet 140. As used in this disclosure, a "drainage path inlet," is a part of drainage path 132 within drainage system 128 where the fluid fills in. As used in this disclosure, a "drainage path outlet" is a part of drainage path 132 within drainage system 128 where the fluid empties. In a non-limiting example, the water on deck 108 of electric watercraft 100 may flow from drainage path inlet 136 (first point) to drainage path outlet 140 (second point).

With continued reference to FIG. 1, deck 108 and drainage path inlet 136 are configured to flow fluid from a topside of deck 108 of electric watercraft 100. In some cases, topside of deck 108 may include, but is not limited to, a footwell 148, a aft platform 148, and the like. As used in this disclosure, a "footwell" is the space for the feet in front of the passenger seat 112. In some embodiments, deck 108 and drainage path inlet 136 may further configured to flow fluid from topside of deck 108 when electric watercraft 100 is in use. For example, deck 108 and drainage path inlet 136 may flow fluid from aft platform 148 when electric watercraft 100 is moving forward at a constant speed. In other embodiments, deck 108 and drainage path inlet 136 may further configured to flow fluid from topside of the deck when electric watercraft 100 is not in use. For example, deck 108 and drainage path inlet 136 may flow fluid from footwell 144 when electric watercraft 100 is powered off and at a stationary position.

With continued reference to FIG. 1, drainage path 132 may be configured to avoid electrically sensitive components of the electric watercraft 100. As used in this disclosure, an "electrically sensitive component" is an electronic component/device that is extremely susceptible to damage from contacting with fluid. In some cases, electrically sensitive component may include, but is not limited to, battery pack 124, controller 152, electric propulsor 116, electric motor 120, and the like. In some embodiments, electrically sensitive components may be contained within a housing. As used in this disclosure, a "housing," is a protective device that surrounds electrically sensitive component, isolating the electrically sensitive components with the outside environment and/or materials. For example, plurality of battery packs 124 may be contained within a battery housing that prevent plurality of battery packs 124 from being soaked in water within hull 104 of electric watercraft 100. In other embodiments, drainage path 132 within drainage system 128 of electric watercraft 100 may be placed in a certain layout that bypass the electrically sensitive component. For instance, drainage path 132 may be located a certain distance away from electrically sensitive component within hull 104 of electric watercraft 100. For another example, drainage path 132 may be placed in a layer above and/or below and/or next to electrically sensitive component within hull 104 of electric watercraft.

With continued reference to FIG. 1, drainage system 128 may further include at least a passive drainage configured to passively direct a flow of fluid from drainage path inlet 136 to drainage path outlet 140. For example, passive drainage of drainage system 128 may passively direct a flow of fluid from drainage path inlet 136 to drainage path outlet 140 when electric watercraft 100 may be stationary. In some cases, electric watercraft 100 may be stationary while power on. In other cases, electric watercraft 100 may be stationary while power off. In some embodiments, passive drainage may include a drainage path 132. In some cases, drainage path inlet 136 of drainage path 132 may include a surface that provide a slight gradient in topside of the deck 108 to readily direct flow of water in on the topside toward the inlet. For example, passive drainage may include a drainage path 132, wherein drainage path 132 may include drainage inlet 136 with chamfered edge about drainage inlet 136 in footwell 144 on deck 108 of electric watercraft 100. In other cases, passive drainage may include a plurality of valves. As used in this disclosure, a "valve" is a component that controls fluidic communication between two or more components. Exemplary non-limiting valves include directional valves, control valves, selector valves, multi-port valves, check valves, and the like. Valves may include any suitable valve construction including ball valves, butterfly valves, needle valves, globe valves, gate valves, wafer valves, regulator valves, and the like. Valves may be included in a manifold of hydraulic or pneumatic circuit, for example allowing for multiple ports and flow paths. Valves may be actuated by any known method, such as without limitation by way of hydraulic, pneumatic, mechanical, or electrical energy. For example, passive drainage may include a check valve near drainage path inlet 136 to prevent water from moving from drainage path 132 and out from drainage inlet 136. As used in this disclosure, a "check valve" is a valve within drainage path 132 that allows fluid inside to flow only one direction. In another example, drainage path outlet 140 may include a check valve to prevent ingress of environmental fluid into drainage path, such as water of the surrounding environment from entering drainage path 132 through drainage path outlet 140. In other embodiments, drainage path inlet 136 of drainage path 132 within passive drainage may include an inlet grate. Inlet grate may prevent user or debris from going into drainage path 132 and/or to protect valve of drainage path inlet 136. Passive drainage disclosed here will be described in further detail below.

With continued reference to FIG. 1, drainage system 128 may further include at least an active drainage. As used in this disclosure, an "active drainage" is a type of drainage system 128 where flow of fluid is actively directed from drainage path inlet 136 to drainage path outlet 140. In an embodiment, active drainage may further include at least a pump, Wherein the at least a pump is configured to connect to electric propulsor 116 and pump a flow of fluid within drainage path 132 as a function of an operation of electric propulsor 116. For instance, active drainage of drainage system 128 may be active when electric watercraft 100 may be propelled and move in certain direction on fluid. In some cases, pump may include a substantially constant pressure pump (e.g., centrifugal pump) or a substantially constant flow pump (e.g., positive displacement pump, gear pump, and the like). In some embodiments, pump can be hydrostatic or hydrodynamic. As used in this disclosure, a "pump" is a mechanical source of power that converts mechanical power into fluidic energy. A pump may generate flow with enough power to overcome pressure induced by a load at a pump outlet. A pump may generate a vacuum at a pump inlet, thereby forcing fluid from a reservoir into the pump inlet to the pump and by mechanical action delivering this fluid to a pump outlet. Hydrostatic pumps are positive displacement pumps. Hydrodynamic pumps can be fixed displacement pumps, in which displacement may not be adjusted, or variable displacement pumps, in which the displacement may be adjusted. Exemplary non-limiting pumps include gear pumps, rotary vane pumps, screw pumps, bent axis pumps, inline axial piston pumps, radial piston pumps, and the like. Pump may be powered by any rotational mechanical work source, for example without limitation and electric motor or a power take off from an engine. Pump may be in fluidic communication with at least a reservoir. In some cases, reservoir may be unpressurized and/or vented. Alternatively, reservoir may be pressurized and/or sealed.

With continued reference to FIG. 1, in some embodiments, pump within active drainage may be an electric pump. As used in this disclosure, an "electric pump" is an electric device that moves fluids by mechanical action through electric power. For example, active drainage may include an electric pump mechanically connected to drainage path 132, wherein the electric pump pushes/pulls water through the channel of drainage path 132. In some embodiments, electric pump may include a bilge pump. As used in this disclosure, a "bilge pump" is a fluid pump used to remove fluid in the bilge of the electric watercraft 100. As used in this disclosure, a "bilge" is an area that is the lowest part of hull 104. In some embodiments, the electric pump may locate at the lowest point of the bilge. In some cases, electric pump may be connected to the drainage path 132. In some embodiments, active drainage may be configured to receive at least an activation signal and pump a flow of fluid within drainage path 132 as a function of the at least an activation signal. In a non-limiting example, the electric pump may be a bilge pump, wherein bilge pump may be connected to drainage path 132. Bilge pump may be powered on upon receiving the at least an activation signal. Bilge pump may take in a flow of water from bilge through drainage path inlet 136 and pump the flow of water through drainage path 132 to drainage path outlet 140. Active drainage disclosed here will be described in further detail below.

With continued reference to FIG. 1, in some embodiments, pump within active drainage may include an impeller pump configured connected to the at least drainage path 132 as a function of a venturi pump configuration. As used in this disclosure, a "impeller pump" is a pump with an impeller, where the impeller is a rotating component that accelerates fluid within the pump. In some cease, impeller may be a short cylinder with an open inlet to accept incoming fluid. In a non-limiting example, impeller pump may be a centrifugal pump, wherein the centrifugal pump includes an impeller, wherein the impeller further accelerates fluid outward from a center of impeller (i.e., rotation). In some cases, impeller pump may transfer energy from electric motor 120 to fluid being pumped. As used in this disclosure, a "venturi pump configuration" is a configuration for pump by applying a venturi effect. As used in this disclosure, a "venturi effect" is a reduction in fluid pressure that results when a fluid flows through a constricted section of a pipe. In some cases, pipe may be a pipe that connect impeller pump and the at least drainage path 132. In some embodiments, venturi pump configuration may further include utilizing a flow rate and/or pressure within drainage path 132, wherein the flow rate is a volume of fluid which passes per unit time. In some embodiments, venturi pump configuration may include using a propulsion pump to actively pull a vacuum. In a non-limiting example, propulsion pump may input a flow of fluid at a first flow rate into drainage path 132, creating a fluid mixture flow at a second flow rate, wherein the second flow rate is lower than the first flow rate, and generate a suction at pump inlet as a function of a difference between first flow rate and second flow rate. In some embodiments, pump within active drainage may include a dedicated drain pump configured connected to a dedicated motor, wherein the dedicated motor may be a separate motor from electric motor 120. As used in this disclosure, a "dedicated drain pump" is a pump that is engineered to be dedicated in a fluid. In some cases, dedicated drain pump may further include isolation with fluid. In some embodiments, dedicated drain pump may be located within drainage path 132.

With continued reference to FIG. 1, active drainage of drainage system 128 may further include at least a sensor. In an embodiment, sensor may be attached to one or more battery pack of plurality battery packs 124. In another embodiment, sensor may be remote to plurality of the battery packs 124. Sensor may be communicatively connected to any other computing device disclosed in this disclosure. In some cases, sensor may include a plurality of sensors. In one or more embodiments, and without limitation, sensor may include one or more temperature sensor, voltmeter, current sensor, hydrometer, infrared sensor, photoelectric sensor, ionization smoke sensor, motion sensor, pressure sensor, radiation sensor, level sensor, imaging device, moisture sensor, gas and chemical sensor, flame sensor, electrical sensor, imaging sensor, force sensor, Hall sensor, and the like. In some cases, sensor may be a contact or a non-contact sensor. For example, and without limitation, sensor may be connected to electric watercraft 100. In some embodiments, sensor may be further configured to detect a fluid parameter on the electric watercraft. As used in this disclosure, a "fluid parameter" is any data regarding to fluid on/in electric watercraft 100. In an embodiment, fluid parameter may include measurement of fluid. In some cases, measurement may include, but is not limited to, moisture level, fluid level, fluid flow rate, and the like. In another embodiment, fluid parameter may include fluid information. In some cases, fluid information may include, but is not limited to, fluid type, fluid density, fluid presence, and the like. In other cases, fluid parameter may also include data regarding to the electric circuit within electric watercraft 100 such as electrical continuity, electrical capacitance, and the like. In some embodiments, sensor may further generate an activation signal as a function of fluid parameter. In a non-limiting example, sensor of active drainage may detect a water level of the collection of water within hull 104 of electric watercraft 100 exceed a water level threshold. Sensor may then generate an activation signal as a function of the detected water level and send the activation signal to active drainage. Electric pump within active drainage may then start pump the collection of water within hull 104 out of electric watercraft 100 through drainage path 132 upon receiving activation signal from sensor.

With continued reference to FIG. 1, active drainage of drainage system 128 may further include at least a controller 152 communicatively connected to a user interface 156. Controller 152 may include any computing device as described in this disclosure, including without limitation a microcontroller, microprocessor, digital signal processor (DSP) and/or system on a chip (SoC) as described in this disclosure. Computing device may include, be included in, and/or communicate with a mobile device such as a mobile telephone or smartphone. Controller 152 may include a single computing device operating independently, or may include two or more computing device operating in concert, in parallel, sequentially or the like; two or more computing devices may be included together in a single computing device or in two or more computing devices. Controller 152 may interface or communicate with one or more additional devices as described below in further detail via a network interface device. Network interface device may be utilized for connecting controller 152 to one or more of a variety of networks, and one or more devices. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network may employ a wired and/or a wireless mode of communication. In general, any network topology may be used. Information (e.g., data, software etc.) may be communicated to and/or from a computer and/or a computing device. Controller 152 may include but is not limited to, for example, a computing device or cluster of computing devices in a first location and a second computing device or cluster of computing devices in a second location. Controller 152 may include one or more computing devices dedicated to data storage, security, distribution of traffic for load balancing, and the like. Controller 152 may distribute one or more computing tasks as described below across a plurality of computing devices of computing device, which may operate in parallel, in series, redundantly, or in any other manner used for distribution of tasks or memory between computing devices. Controller 152 may be implemented using a "shared nothing" architecture in which data is cached at the worker, in an embodiment, this may enable scalability of the electric watercraft 100 and/or computing device.

With continued reference to FIG. 1, controller 152 may be designed and/or configured to perform any method, method step, or sequence of method steps in any embodiment described in this disclosure, in any order and with any degree of repetition. For instance, Controller 152 may be configured to perform a single step or sequence repeatedly until a desired or commanded outcome is achieved; repetition of a step or a sequence of steps may be performed iteratively and/or recursively using outputs of previous repetitions as inputs to subsequent repetitions, aggregating inputs and/or outputs of repetitions to produce an aggregate result, reduction or decrement of one or more variables such as global variables, and/or division of a larger processing task into a set of iteratively addressed smaller processing tasks. Controller 152 may perform any step or sequence of steps as described in this disclosure in parallel, such as simultaneously and/or substantially simultaneously performing a step two or more times using two or more parallel threads, processor cores, or the like; division of tasks between parallel threads and/or processes may be performed according to any protocol suitable for division of tasks between iterations. Persons skilled in the art, upon reviewing the entirety of this disclosure, will be aware of various ways in which steps, sequences of steps, processing tasks, and/or data may be subdivided, shared, or otherwise dealt with using iteration, recursion, and/or parallel processing.

With continued reference to FIG. 1, controller 152 may further include a signal receiver. As used in this disclosure, A "signal receiver" is an electronic component that listens to, and receives a first signal from other electronic components, wherein a signal may include one or more digital and/or analog signals. In an embodiment, first signal may be an warning signal. Controller 124 may be further configured to, without limitation, perform preprocessing, lexical analysis, parsing, semantic analysis of first signal, and the like. In some embodiment, controller 152 may also include a signal transmitter. As used in this disclosure, a "signal transmitter" is a component that transmits/sends a signal to other components. In some cases, signal transmitter may additionally transform a signal, for example a first signal into a second signal. In other cases, signal transmitter may pass signal received from signal receiver of controller 152 to other components. In a non-limiting example, signal transmitter may pass activation signal generated by sensor of active drainage received from signal receiver to electric pump of active drainage.

With continued reference to FIG. 1, user interface 156 may be located at the front of electric watercraft 100 and/or within the sight of the user. As used in this disclosure, a "user interface" is a device that provides interactions between the user and the controller 152. User interface 156 may include a screen. In some embodiments, user interface 156 may be black and white. In other embodiments, user interface 156 may be in color. User interface 156 may display information regarding to the electric watercraft 100. In some cases, information may include, without limitation, the speed, battery status, hull status, throttle status, light setting, user manual, warnings, and the like of the electric watercraft 100. User interface 156 may include a plurality of user interfaces. Each user interface of plurality of user interfaces 156 may display different information. For instance, a first user interface 156 may display the instantaneous speed and throttle status of electric watercraft 100, and a second user interface 156 may display the current battery status and warnings of electric watercraft 100. In an embodiment, controller 152 may be embedded in user interface 156. In this case, user interface 156 may include a touch screen.

With continued reference to FIG. 1, controller 152 may be further configured to receive a user input from the user and control active drainage as a function of the user input. In some cases, user input may include, but is not limited to, turn on/off active drainage, change the pump power of active drainage, change the fluid flow rate of active drainage, change the flow direction of active drainage, and the like. In a non-limiting example, controller 152 may receive a user input of turn on active drainage. Controller 152 may then generate an activation signal of turn on active drainage and send the activation signal to active drainage. Electric pump within active drainage may then start pump the water within drainage path 132 to drainage path outlet 140 upon receiving activation signal from controller 152. In another example, controller 152 may receive a user input of increase the pump power of active drainage. Controller 152 may then set a first pump power of electric pump within active drainage to a second pump power, wherein the second pump power is greater than the first pump power.

With continued reference to FIG. 1, controller 152 of electric watercraft 100 may further communicatively connected to the at least a sensor of active drainage. In some cases, controller 152 may be further configured to receive fluid parameter from sensor of active drainage. In some cases, controller 152 may be further configured to display, using user interface 156, a drainage system status as a function of fluid parameter. As used in this disclosure, a "drainage system status" are system information and/or status regarding to the drainage system 128 of the electric watercraft 100. In a non-limiting example, sensor of active drainage may detect a water presence within drainage path 132. Sensor may send a fluid parameter as a function of the water presence to controller 152. Controller 152 may display water presence information within drainage path 132 on user interface 156. In some embodiments, drainage system status may include active drainage status. In some cases, active drainage status may include, but is not limited to, drainage path status, drainage path inlet fluid injection volume, drainage path outlet output volume, electric pump status, and the like. In a non-limiting example, sensor may detect water level on deck 108 of electric watercraft 100. Sensor may generate activation signal as a function of a water level when the water level exceeds water level threshold for deck 108. Sensor may further send activation signal to active drainage; wherein active drainage may bring a flow of water through the drainage path inlet 136 into drainage path 132 and pump the flow of water out of electric watercraft 100 through the drainage path outlet 140. Sensor may also send fluid parameter to controller 152 in addition to activation signal. Controller 152 may display, using user interface 156, drainage path inlet fluid injection volume information and/or drainage path outlet output volume on user interface 156. In some embodiments, the drainage system status may further include an active drainage warning. In some cases, active drainage warning may include, but is not limited to, active drainage failure, pump failure, active drainage circuit trip, active drainage blockage, and the like. In a non-limiting example, upon receiving fluid parameter regarding to water input volume and water output volume, controller 152 may display, using user interface 156, an active drainage warning, wherein the active drainage warning indicates active drainage blockage, when water output volume is less than water input volume.

Figure 2:
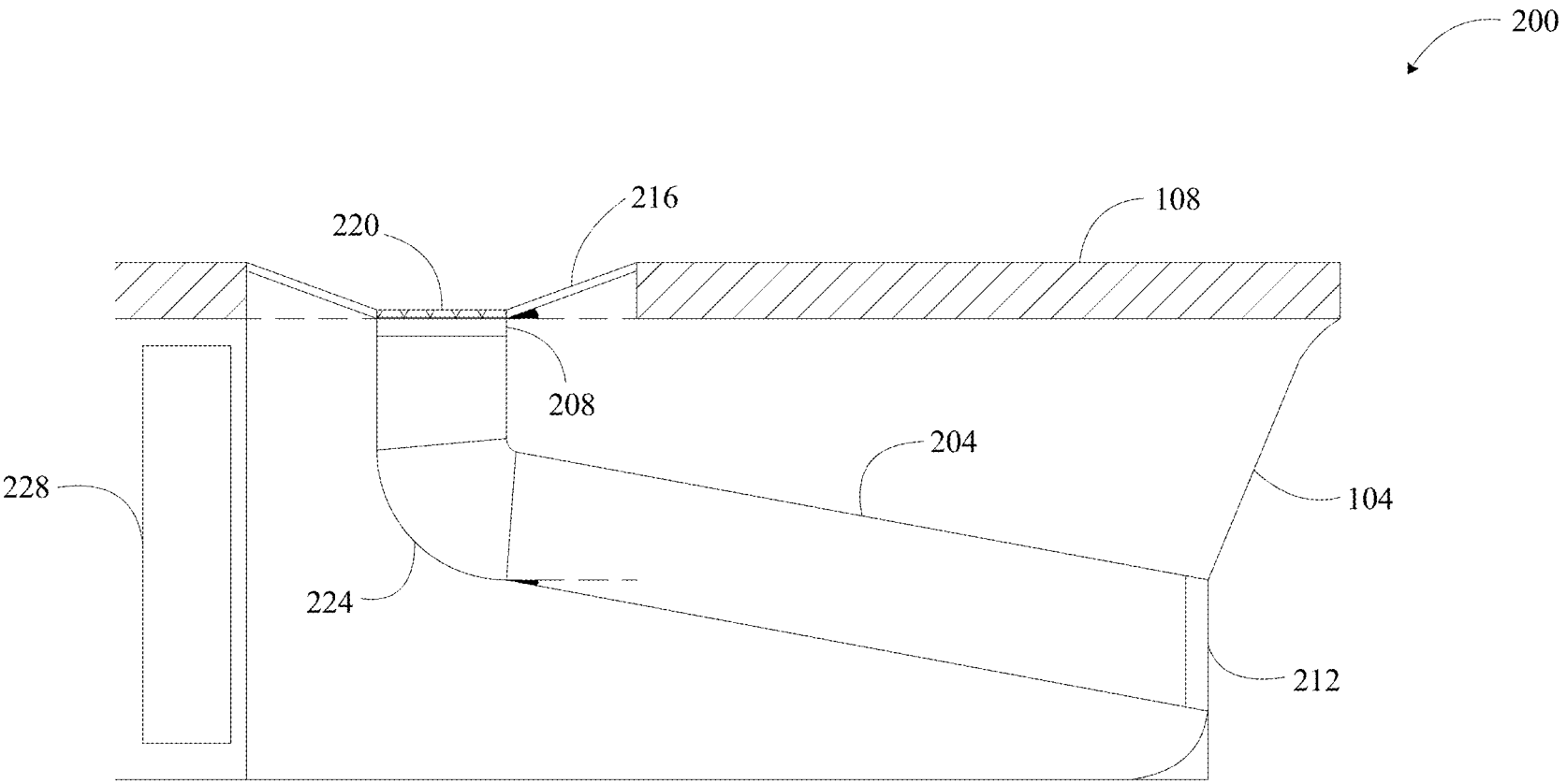

Referring now to FIG. 2, an exemplary embodiment of a passive drainage 200 of drainage system 128 is illustrated. In an embodiment, passive drainage 200 may include a passive drainage path 204. In some cases, passive drainage path may be a pipe that direct flowing fluid. In some cases, passive drainage path may be made by metal material, such as copper, steel, and the like. In other cases, passive drainage path may be made by non-metal material, such as plastic, polyvinyl chloride, and the like. In some embodiment, passive drainage path 204 may be installed within hull 104 beneath deck 108. Further, passive drainage path 204 may be angled to hull 104 and/or deck 108. In other embodiment, passive drainage path 204 may be in parallel with hull 104 and/or deck 108.

With continued reference to FIG. 2, passive drainage path 204 may further include a passive drainage path inlet 208 and a passive drainage path outlet 212. In some embodiments, fluid on deck 108 may fill in from passive drainage path inlet 208 and out from passive drainage path outlet 212 when electric watercraft 100 is in use. In other embodiments, fluid on deck 108 may fill in from passive drainage path inlet 208 and out from passive drainage path outlet 212 when electric watercraft 100 is not in use. In some cases, passive drainage path inlet 208 may be located on topside of deck 108 such as footwell 144, aft platform 148, and the like. In some embodiments, passive drainage path 204 may further include a valve 224. In some cases, valve 224 may include directional valve, control valve, selector valve, and the like. For instance, passive drainage path 204 may include a check valve 224, wherein the check valve 224 may be installed within passive drainage path 204 near passive drainage path inlet 208 to prevent water from moving from passive drainage path 204 and out from passive drainage inlet 208. In some cases, passive drainage path inlet 208 may further include an inlet edge 216. Inlet edge 216 may be around passive drainage path inlet 208. In some embodiments, inlet edge 216 may provide a gradient in hull 104 or deck 108. In other cases, passive drainage path inlet 208 may further include an inlet grate 220. Inlet grate 220 may prevents user or debris from entering passive drainage path 204. Further, inlet grate 220 may protect valve 224 of passive drainage path 204.

With continued reference to FIG. 2, passive drainage path 204 may further be configured to avoid electrically sensitive component 228. In some cases, electrically sensitive component 228 may include, but is not limited to, battery pack 124, controller 152, electric propulsor 116, electric motor 120, and the like. In some embodiments, electrically sensitive component 228 may be contained within housing. In some cases, passive drainage path 204 may be located a certain distance away from electric sensitive component 228. In other cases, passive drainage path 204 may be installed in a separate layer from electric sensitive component 228. For instance, electrically sensitive component 228 may be contained in a chamber separate from passive drainage path 204.

Figure 3:
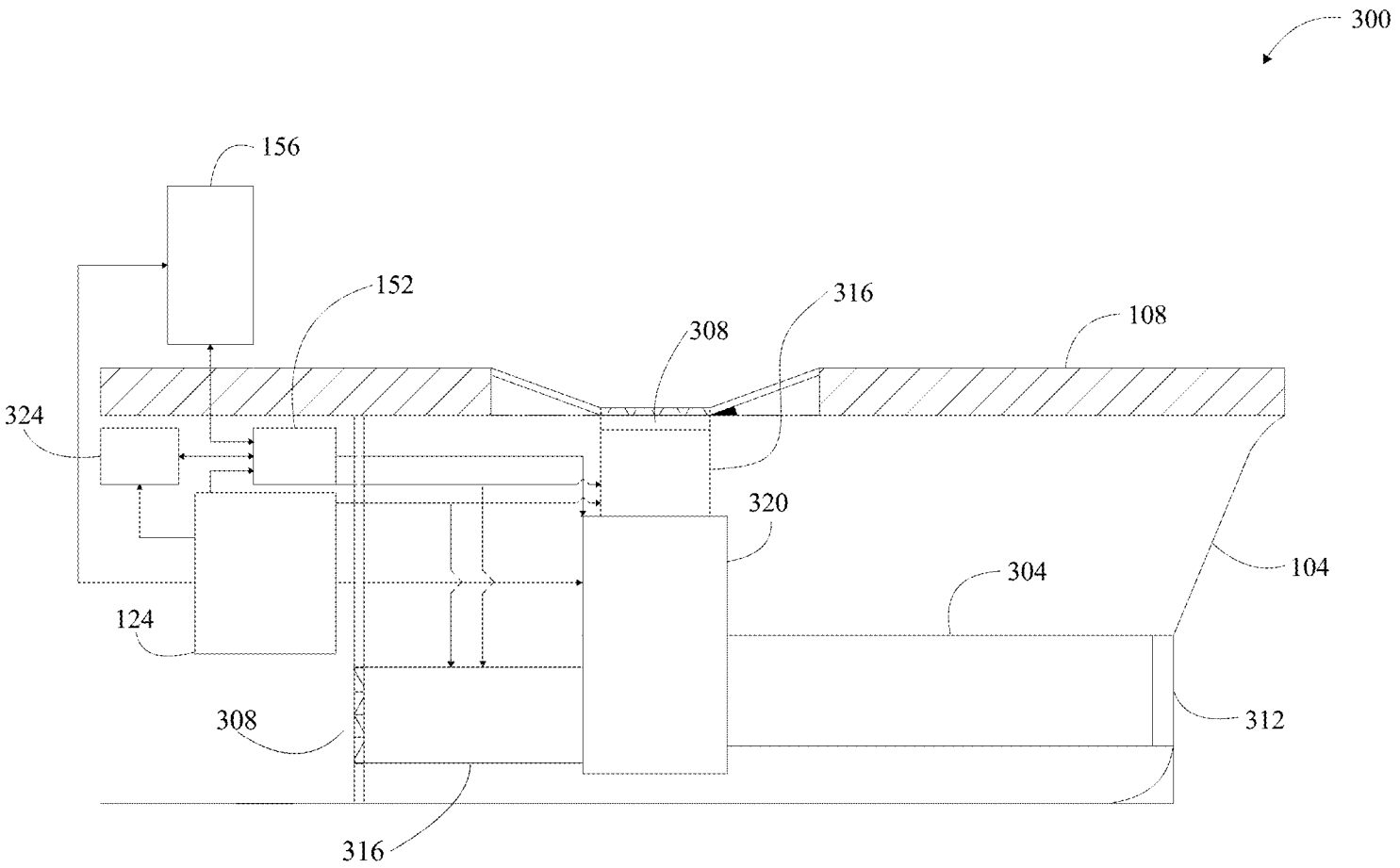

Referring now to FIG. 3, an exemplary embodiment of an active drainage 300 of drainage system 128 is illustrated. In an embodiment, active drainage 300 may include all components in passive drainage 200 disclosed above in reference to FIG. 2. Active drainage 300 may include an active drainage path 304. In some embodiment, active drainage path 304 may be installed within hull 104 beneath deck 108. Further, active drainage path 304 may be angled to hull 104 and/or deck 108. In other embodiment, active drainage path 304 may be in parallel with hull 104 and/or deck 108. Active drainage path 304 may further include an active drainage path inlet 308 and an active drainage path outlet 312. In some cases, active drainage path inlet 308 may be located within hull 104 of electric watercraft 100. For example, fluid inside hull 104 may drain or be pumped into active drainage path inlet 308 and out from active drainage path outlet 312 when electric watercraft 100 is in use. For another example, fluid inside hull 104 drain or be pumped into active drainage path inlet 308 and out from active drainage path outlet 312 when electric watercraft 100 is not in use. Alternatively or additionally, active drainage path inlet 308 may be located on topside of deck 108 such as footwell 144, aft platform 148, and the like.

With continued reference to FIG. 3, active drainage path 304 may further include a valve 316. In some cases, valve 216 may include directional valve, control valve, selector valve, and the like. For instance, active drainage path 304 may include a check valve 316, wherein the check valve 316 may be installed within active drainage path 304 to prevent water moving from active drainage path 304 and out from active drainage inlet 308. In some embodiments, valve 316 may be controlled by controller 152. In some cases, controller 152 may be in communication with valve, for example by way of one or more of electrical communication, hydraulic communication, pneumatic communication, mechanical communication, and the like. In other cases, controller 104 may be in communication with one or more components (e.g., valve, pump, sensors, and the like) by way of one or more networks, including for example wireless networks and controller area networks (CANs). In some embodiments, valve 316 may be in connection with one or more power sources such as battery pack 124.

With continued reference to FIG. 3, active drainage may include a pump 320. In some cases, pump 320 may include, but is not limited to, gear pumps, rotary vane pumps, screw pumps, and the like. In an embodiment, pump 320 may be an electric pump. In some cases, pump 320 may be connected with active drainage path 304. In some embodiments, pump 320 may be powered by one or more power source such as battery pack 124. In some embodiments, pump 320 may be communicatively connected with controller 152. In some embodiments, pump 320 may receive an activation signal from controller 152. Further, pump 320 may pump a flow of fluid within active drainage path 304 as a function of activation signal received. For instance, pump 320 may be an electric bilge pump and connected to active drainage path 304. Pump 320 may be powered on by battery pack 124 upon receiving activation signal from controller 152. Pump 320 may further bring in a flow of water inside hull 104 of electric watercraft 100 through active drainage path inlet 308 and pump the flow of water through active drainage path 304 to active drainage path 312.

With continued reference to FIG. 3, active drainage may include a sensor 324. In some cases, sensor 324 may include, but is not limited to, temperature sensor, motion sensor, pressure sensor, moisture sensor, and the like. In some embodiments, sensor 324 may be powered by one or more power source such as battery pack 124. In some embodiments, sensor 324 may be communicatively connected with controller 152. Further, sensor 324 may be configured to detect fluid parameter. In some cases, sensor 324 may generate activation signal as a function of fluid parameter detected. For example, sensor 324 may detect a water level of the collection of water within hull 104 exceed certain water level threshold. Sensor 324 may then generate an activation signal as a function of the detected water level and send the activation signal to controller 152. Controller 152 may pass activation signal received from sensor 324 to pump 320. Pump 320 may then start pump the water out of electric watercraft 100 through active drainage path 304 upon receiving activation signal from controller 152.

With continued reference to FIG. 3, controller 152 within active drainage 300 may further communicatively connect with user interface 156. In some cases, user interface 156 may be located at the front of electric watercraft 100 above deck 108. In some embodiments, user interface 156 may be powered by one or more power source such as battery pack 124. Controller 152 may be further configured to receive a user input and control active drainage 300 as a function of the user input received. For example, controller 152 may receive a user input of turn on pump 320. Controller 152 may then generate an activation signal and send the activation signal to pump 320 as a function of user input. Pump 320 may then power on upon receiving activation signal from controller 152. In other embodiments, controller 152 may be configured to receive a fluid parameter from sensor 324. In some cases, controller 152 may be further configured to display using interface drainage system status. For example, controller 152 may display active drainage blockage warning through user interface 156 when fluid parameter received from sensor 324 contain data regarding detected abnormal input/output fluid volume within active drainage 300.

Figure 4:
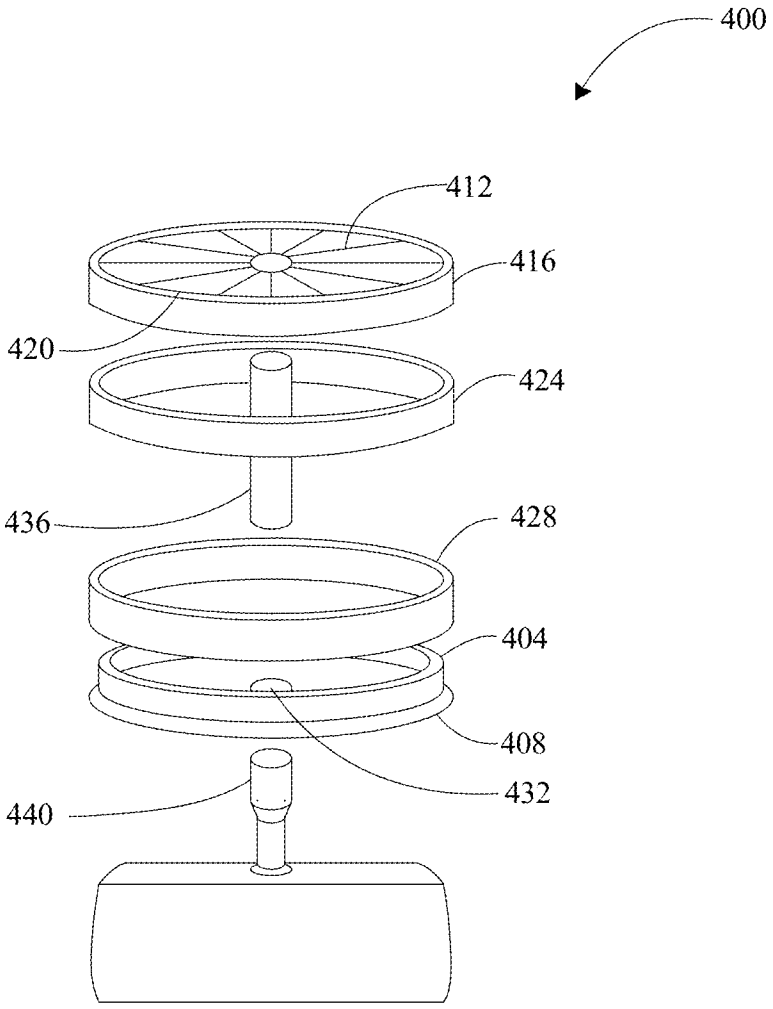

Referring now to FIG. 4, an embodiment of motor is illustrated. Electric motor 400 may include at least a stator 404. As used in this disclosure, a "stator" is a stationary component of a motor and/or motor assembly. In an embodiment, stator 404 may include at least first magnetic element 408. As used in this disclosure, a "first magnetic element" is an element that generates a magnetic field. For example, first magnetic element 408 may include one or more magnets which may be assembled in rows along a structural casing component. Further, first magnetic element 408 may include one or more magnets having magnetic poles oriented in at least a first direction. In some embodiments, magnets may include at least a permanent magnet. In some cases, permanent magnets may be composed of, but are not limited to, ceramic, alnico, samarium cobalt, neodymium iron boron materials, any rare earth magnets, and the like. In other embodiments, the magnets may include an electromagnet. As used in this disclosure, an "electromagnet" is an electrical component that generates magnetic field via induction. In some cases, electromagnet may include a coil of electrically conducting material, through which an electric current flow to generate the magnetic field, also called a field coil of field winding. In some cases, a coil may be wound around a magnetic core, which may include without limitation an iron core or other magnetic material. In some cases, core may include a plurality of steel rings insulated from one another and then laminated together. In an embodiment, plurality of steel rings may include slots in which the conducting wire will wrap around to form a coil. In some cases, first magnetic element 408 may act to produce or generate a magnetic field to cause other magnetic elements to rotate, as described in further detail below. In some embodiments, stator 404 may include a frame to house components including first magnetic element 408, as well as one or more other elements or components as described in further detail below. In other embodiments, magnetic field may be generated by first magnetic element 408 and can include a variable magnetic field. For example, variable magnetic field may be achieved by use of an inverter, a controller, or the like.

With continued reference to FIG. 4, electric motor 400 may include propulsor 412. In some embodiments, propulsor 412 may include an integrated rotor. As used in this disclosure, a "rotor" is a portion of an electric motor that rotates with respect to a stator of the electric motor, such as stator 404. As used in this disclosure, a "propulsor" is a component or device used to propel a vehicle by exerting force on a fluid medium, which may include a gaseous medium such as air or a liquid medium such as water. In some cases, propulsor 412 may be any device or component that consumes electrical power on demand to propel an aircraft or other vehicle while on ground and/or in flight. In other cases, propulsor 412 may include one or more propulsive devices. In an embodiment, propulsor 412 may include a thrust element which may be integrated into propulsor. In some cases, a thrust element may include any device or component that converts the mechanical energy of a motor, for instance in the form of rotational motion of a shaft, into thrust in a fluid medium. For example, thrust element may include without limitation a marine propeller or screw, an impeller, a turbine, a pump-jet, a paddle or paddle-based device, or the like. In an embodiment, electric motor of electric watercraft may include a propulsor, wherein propulsor may include an impeller coupled with the rotor shaft. As used in this disclosure, an "impeller," is a rotor used to increase or decrease the pressure and flow of a fluid. In some cases, impeller may contain a cylinder with an open inlet to accept fluid. In some embodiments, impeller may include a plurality of metal blades around the center of the rotation (rotor shaft). In some cases, plurality of metal blades may push fluid radially. In other embodiments, impeller may also include a bore to accept a driver shaft, wherein the bore may be, but not limited to, splined, keyed, or threaded. In some cases, impeller may increase the pressure of the water. In other cases, impeller may also accelerate fluid outward from the center of rotation, transferring electric energy from electric motor that drives propulsor to fluid being output.

With continued reference to FIG. 4, in an embodiment, propulsor 412 may include a hub 416 rotatably mounted to stator 404. As used in this disclosure, "rotatably mounted," is functionally secured in a manner to allow rotation. As used in this disclosure, a "hub 416" is a structure which allows for the mechanically coupling of components of an integrated rotor assembly. In an embodiment, hub 416 may be mechanically coupled to propellers or blades. In an embodiment, hub 416 may be cylindrical in shape such that it may be mechanically joined to other components of rotor assembly. In some cases, hub 416 may be constructed of any suitable material or combination of materials, including without limitation metal such as aluminum, titanium, steel, or the like, polymer materials or composites, fiberglass, carbon fiber, wood, or any other suitable material. In other cases, hub 416 may move in a rotational manner driven by interaction between stator and components in rotor assembly. Persons skilled in the art, upon reviewing the entirety of this disclosure, will be aware of various structures that may be used as or included as hub 416, as used and described herein.

With continued reference to FIG. 4, in an embodiment, propulsor 412 and/or rotor shaft 436 may include second magnetic element 420, which may include one or more further magnetic elements. In some embodiment, second magnetic element 420 generates magnetic field designed to interact with first magnetic element 408. Further, second magnetic element 420 may be designed with a material such that magnetic poles of at least a second magnetic element are oriented in an opposite direction from first magnetic element 408. In other embodiments, second magnetic element 420 may be affixed to hub 416, rotor shaft 436, or another rotating or stationary electric motor component disclosed herein. As used in this disclosure, "Affixed," is the attachment, fastening, connection, and the like, of one component to another component. For example, and without limitation, affixed may include bonding second magnetic element 420 to hub 416, such as through hardware assembly, spot welding, riveting, brazing, soldering, glue, and the like. In some cases, second magnetic element 420 may include any magnetic element suitable for use as first magnetic element 408. For instance, and without limitation, second magnetic element may include a permanent magnet and/or an electromagnet. In other cases, second magnetic element 420 may include magnetic poles oriented in a second direction opposite, in whole or in part, of the orientation of poles of first magnetic element 408. In an embodiment, Electric motor 400 may include motor assembly incorporating stator 404 with first magnet element and second magnetic element 420. In some cases, first magnetic element 408 may include a plurality of magnetic poles oriented in a first direction, second magnetic element includes a plurality of magnetic poles oriented in an opposite direction than the plurality of magnetic poles in first magnetic element 408.

With continued reference to FIG. 4, in an embodiment, first magnetic element 408 may be a productive element. As used in this disclosure, a "productive element" is an element that produces a varying magnetic field. In some cases, productive elements may produce magnetic field that may attract and other magnetic elements, possibly including a receptive element. In some cases, second magnetic element may be productive or receptive element. A receptive element may react due to magnetic field of first magnetic element 408. In some embodiments, first magnetic element 408 may produce magnetic field according to magnetic poles of first magnetic element 408 oriented in first direction. Second magnetic element 420 may produce magnetic field with magnetic poles in opposite direction of first magnetic field, which may cause two magnetic elements to attract one another. Receptive magnetic element may be slightly larger in diameter than productive element. Interaction of productive and receptive magnetic elements may produce torque and cause the assembly to rotate. In some cases, hub 416 and rotor assembly may both be cylindrical in shape where rotor may have a slightly smaller circumference than hub 416 to allow the joining of both structures. In some embodiments, coupling of hub 416 to stator 404 may be accomplished via a surface modification of either hub 416, stator 404 or both to form a locking mechanism. In other embodiments, coupling may be accomplished using additional nuts, bolts, and/or other fastening apparatuses. In some cases, integrated rotor assembly as described above may reduce profile drag in forward traveling for electric watercraft. Profile drag may be caused by a number of external forces that the watercraft is subjected to. In an embodiment, incorporating propulsor 412 into hub 416, may reduce profile of Electric motor 400 resulting in a reduced profile drag. In some cases, rotor which may include motor inner magnet carrier 424, motor outer magnet carrier 328, propulsor 412 may be incorporated into hub 416. In an embodiment, inner motor magnet carrier 424 may rotate in response to magnetic field. The rotation may cause hub 416 to rotate. This unit may be inserted into Electric motor 400 as one unit. This may enable ease of installation, maintenance, and removal.

With continued reference to FIG. 4, stator 404 may include through-hole 432. In an embodiment, through-hole 432 may provide an opening for a component to be inserted through to aid in attaching propulsor with integrated rotor and rotor shaft to stator. In some cases, through-hole 432 may have a round or cylindrical shape and be located at a rotational axis of stator 404, which in an embodiment may be similar to or the same as axis of rotation. Hub 416 may be mounted to stator 404 by means of rotor shaft 436 rotatably inserted though through-hole 432. In some embodiments, rotor shaft 436 may be mechanically coupled to stator 404 such that rotor shaft 436 is free to rotate about its centerline axis, which may be effectively parallel and coincident to stator's centerline axis, and further rotor shaft and stator may include a void of empty space between them, where at least a portion the outer cylindrical surface of rotor shaft is not physically contacting at least a portion of inner cylindrical surface of stator. In some cases, this void may be filled, in whole or in part, by air, a vacuum, a partial vacuum or other gas or combination of gaseous elements and/or compounds, to name a few. In other embodiments, through-hole 432 may have a diameter that is slightly larger than a diameter of rotor shaft 436 to allow rotor shaft 436 to fit through through-hole 432 to connect stator 404 to hub 416. In some cases, rotor shaft 436 may rotate in response to rotation of propulsor 412.

With continued to FIG. 4, Electric motor 400 may include a bearing cartridge 440. In some cases, bearing cartridge 440 may include a bore. In an embodiment, rotor shaft 436 may be inserted through bore of bearing cartridge 440. In some cases, bearing cartridge 440 may be attached to a structural element of a vehicle. As used in this disclosure, "bearing cartridge" is a component functions to support the rotor and to transfer the loads from the motor. In some cases, loads may include, without limitation, weight, power, magnetic pull, pitch errors, out of balance situations, and the like. In some embodiments, bearing cartridge 440 may include bore. In other embodiments, bearing cartridge 440 may include a smooth metal ball or roller that rolls against a smooth inner and outer metal surface. The rollers or balls take the load, allowing the device to spin. In some cases, bearing cartridge may include, without limitation, ball bearing, straight roller bearing, tapered roller bearing or the like. In an embodiment, bearing cartridge 440 may be subject to load which may include, without limitation, radial or thrust load. Depending on the location of bearing cartridge 440 in the assembly, it may see all radial or thrust load or a combination of both. In some embodiments, bearing cartridge 440 may join electric motor 400 to a structure feature. In some cases, bearing cartridge 440 may function to minimize the structural impact from the transfer of bearing loads during traveling and/or to increase energy efficiency and power of propulsor. In other embodiments, bearing cartridge 440 may include a shaft and a collar arrangement, wherein the shaft affixed into the collar assembly. Further, bearing element may support the two joined structures by reducing transmission of vibration from such bearings. In some cases, roller (rolling-contact) bearings are conventionally used for locating and supporting machine parts such as rotors or rotating shafts. For example, rolling elements of roller bearing may be balls or rollers. In another example, roller bearing may be a type of anti-friction bearing. As used in this disclosure, a "roller bearing" is a type of bearing functions to reduce friction allowing free rotation. Additionally, roller bearing may act to transfer loads between rotating and stationary members. In an embodiment, bearing cartridge 440 may act to keep propulsor 412 and components intact during traveling by allowing Electric motor 400 to rotate freely while resisting loads such as an axial force. In an embodiment, bearing cartridge 440 may include roller bearing incorporated into the bore. In some cases, roller bearing may be in contact with rotor shaft 436. Stator 404 may be mechanically coupled to inverter housing. In some cases, mechanically coupled may include a mechanical fastening, without limitation, such as nuts, bolts, or other fastening device. In some embodiments, mechanically coupled may include welding or casting or the like. In other embodiments, inverter housing may contain bore which allows insertion by rotor shaft 436 into bearing cartridge 440.

With continued reference to FIG. 4, electric motor 400 may include motor assembly incorporating rotating assembly and a stationary assembly. In an embodiment, hub 416, motor inner magnet carrier 424 and rotor shaft 436 may be incorporated into rotor assembly of electric motor 400 which make up rotating parts of electric motor, moving between stator poles and transmitting motor power. As one integrated part, rotor assembly may be inserted and removed in one piece. In some embodiments, stator 404 may be incorporated into the stationary part of the motor assembly. In some cases, stator and rotor may combine to form an electric motor. In other embodiments, electric motor 400 may, for instance, incorporate coils of wire, which may be similar to or the same as any of the electrically conductive components in the entirety of this disclosure, which are driven by the magnetic force exerted by first magnetic field on an electric current. The function of motor may be to convert electrical energy into mechanical energy. In operation, a wire carrying current may create at least a first magnetic field with magnetic poles in a first orientation which interacts with a second magnetic field with magnetic poles oriented in an opposite direction of the first magnetic pole direction causing a force that may move rotor in a direction. For example, and without limitation, first magnetic element 408 in Electric motor 400 may include an active magnet. For instance, and without limitation, second magnetic element may include a passive magnet, the passive magnet that reacts to a magnetic force generated by first magnetic element 408. In an embodiment, first magnet positioned around the rotor assembly, may generate magnetic fields to affect the position of the rotor relative to stator 404. In some cases, controller may have an ability to adjust electricity originating from a power supply and, thereby, the magnetic forces generated, to ensure stable rotation of rotor, independent of the forces induced by the machinery process.

Figure 5:
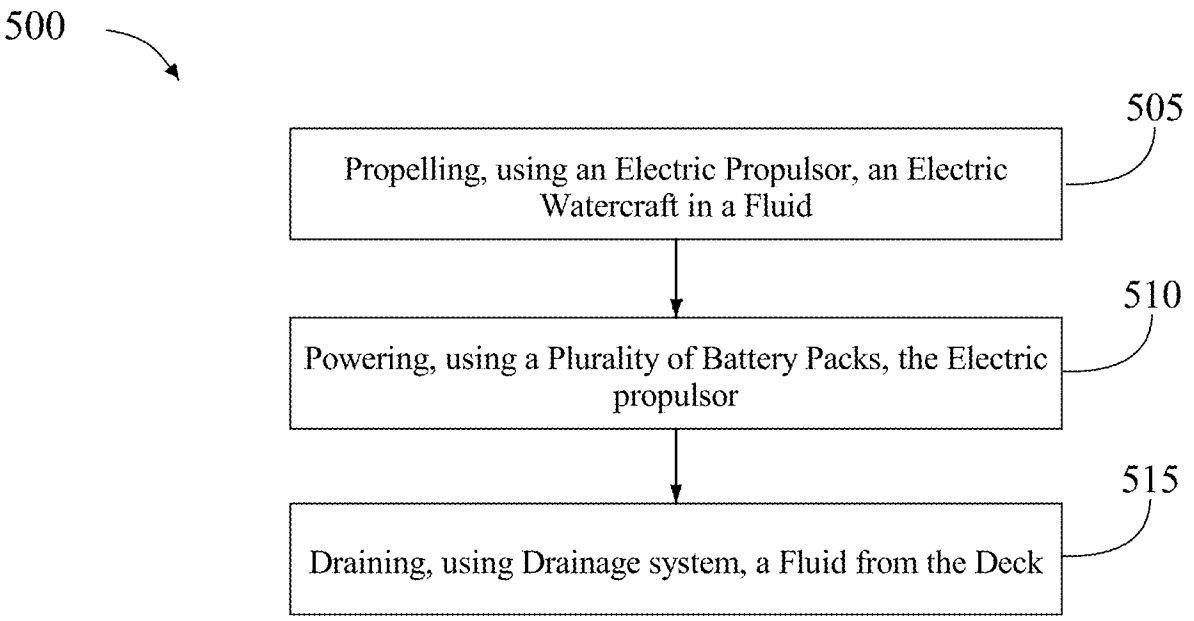

Referring now to FIG. 5, an exemplary method 500 for drainage of water from an electric watercraft is illustrated. Method 500 includes a step 505, of propelling, using at least an electric propulsor, electric watercraft in a fluid. This may be implemented, without limitation, as described above in reference to FIGS. 1-4. In an embodiment, electric watercraft may include an electrically powered jet-propelled personal watercraft. In some embodiments, electric watercraft may include an electric motor. This may be implemented, without limitation, as described above with reference to FIGS. 1-4.

With continued reference to FIG. 5, method 500 includes a step 510, of powering, using a plurality of battery packs located beneath a deck of electric watercraft, at least an electric propulsor. This may be implemented, without limitation, as described above with reference to FIGS. 1-4. In some embodiments, each battery pack of plurality of battery packs may include at least an electric conductor. In some cases, battery pack may include a battery regulator. In other cases, battery pack may include a battery balancer. This may be implemented, without limitation, as described above with reference to FIGS. 1-4.

With continued reference to FIG. 5, method 500 includes a step 515, of draining, using at least a drainage system, a fluid from the deck, wherein the at least a drainage system further includes at least a drainage path having a drainage path inlet and a drainage path outlet, and the deck and the drainage inlet are configured to flow from a topside of the deck of the electric watercraft. This may be implemented, without limitation, as described above with reference to FIGS. 1-4. In some embodiments, the at least a drainage system may include a passive drainage. In some cases, passive drainage may include a plurality of valves. In other embodiments, passive drainage may include an inlet edge around drainage path inlet of drainage system. Additionally, passive drainage may also include an inlet grate in drainage path inlet of drainage system. This may be implemented, as described above, in reference to FIGS. 1-4. In some embodiments, the at least a drainage system may include an active drainage. Active drainage may include all components within passive drainage. In some cases, active drainage may include a pump. In an embodiment, pump may be electric pump powered by plurality of battery packs. In some cases, active drainage may include at least a sensor. In an embodiment, sensor may detect a fluid parameter. Sensor may further generate an activation signal as a function of fluid parameter. This may be implemented, without limitation, as described above in reference to FIGS. 1-4. In some cases, active drainage may further include a controller. In some embodiments, controller may communicatively connect with a user interface. Controller may be further configured to receive a user input from the user and control active drainage of drainage system as a function to the user input. This may be implemented, without limitation, as described above in reference to FIGS. 1-4. In other embodiments, controller may communicatively connect with the at least a sensor. Controller may be further configured to receive fluid parameter from the at least a sensor and display a drainage system status as a function of received fluid parameter through user interface. This may be implemented, without limitation, as described above in reference to FIGS. 1-4.

It is to be noted that any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., CD, CD-R, DVD, DVD-R, etc.), a magneto-optical disk, a read-only memory "ROM" device, a random-access memory "RAM" device, a magnetic card, an optical card, a solid-state memory device, an EPROM, an EEPROM, and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instruction, or portion thereof, for execution by a machine (e.g., a computing device) and any related information (e.g., data structures and data) that causes the machine to perform any one of the methodologies and/or embodiments described herein.

Examples of a computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In one example, a computing device may include and/or be included in a kiosk.

Figure 6:
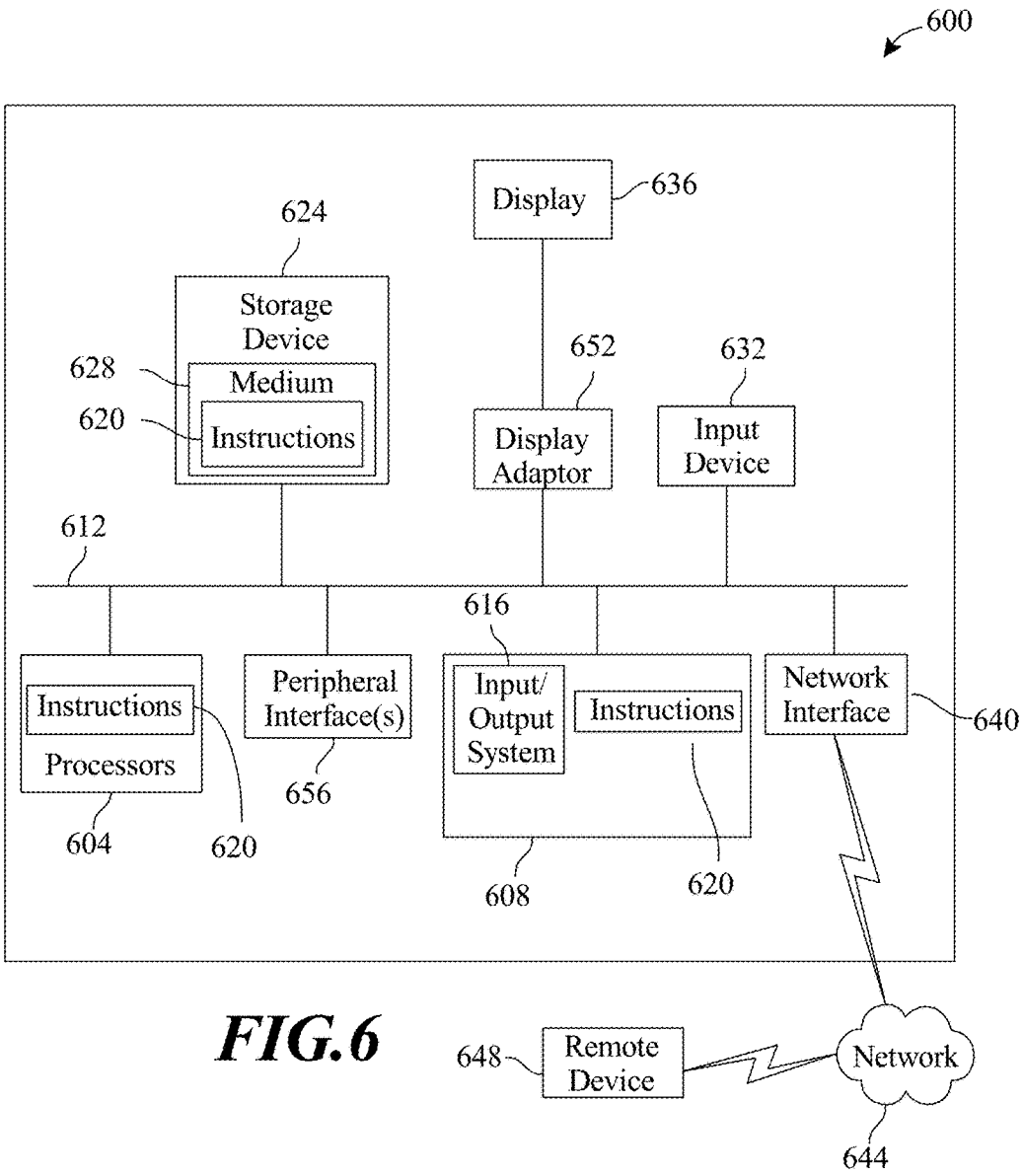

FIG. 6 shows a diagrammatic representation of one embodiment of a computing device in the exemplary form of a computer system 600 within which a set of instructions for causing a control system to perform any one or more of the aspects and/or methodologies of the present disclosure may be executed. It is also contemplated that multiple computing devices may be utilized to implement a specially configured set of instructions for causing one or more of the devices to perform any one or more of the aspects and/or methodologies of the present disclosure. Computer system 600 includes a processor 604 and a memory 608 that communicate with each other, and with other components, via a bus 612. Bus 612 may include any of several types of bus structures including, but not limited to, a memory bus, a memory controller, a peripheral bus, a local bus, and any combinations thereof, using any of a variety of bus architectures.

Processor 604 may include any suitable processor, such as without limitation a processor incorporating logical circuitry for performing arithmetic and logical operations, such as an arithmetic and logic unit (ALU), which may be regulated with a state machine and directed by operational inputs from memory and/or sensors; processor 604 may be organized according to Von Neumann and/or Harvard architecture as a non-limiting example. Processor 604 may include, incorporate, and/or be incorporated in, without limitation, a microcontroller, microprocessor, digital signal processor (DSP), Field Programmable Gate Array (FPGA), Complex Programmable Logic Device (CPLD), Graphical Processing Unit (GPU), general purpose GPU, Tensor Processing Unit (TPU), analog or mixed signal processor, Trusted Platform Module (TPM), a floating-point unit (FPU), and/or system on a chip (SoC).

Memory 608 may include various components (e.g., machine-readable media) including, but not limited to, a random-access memory component, a read only component, and any combinations thereof. In one example, a basic input/output system 616 (BIOS), including basic routines that help to transfer information between elements within computer system 600, such as during start-up, may be stored in memory 608. Memory 608 may also include (e.g., stored on one or more machine-readable media) instructions (e.g., software) 620 embodying any one or more of the aspects and/or methodologies of the present disclosure. In another example, memory 608 may further include any number of program modules including, but not limited to, an operating system, one or more application programs, other program modules, program data, and any combinations thereof.

Computer system 600 may also include a storage device 624. Examples of a storage device (e.g., storage device 624) include, but are not limited to, a hard disk drive, a magnetic disk drive, an optical disc drive in combination with an optical medium, a solid-state memory device, and any combinations thereof. Storage device 624 may be connected to bus 612 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In one example, storage device 624 (or one or more components thereof) may be removably interfaced with computer system 600 (e.g., via an external port connector (not shown)). Particularly, storage device 624 and an associated machine-readable medium 628 may provide nonvolatile and/or volatile storage of machine-readable instructions, data structures, program modules, and/or other data for computer system 600. In one example, software 620 may reside, completely or partially, within machine-readable medium 628. In another example, software 620 may reside, completely or partially, within processor 604.

Computer system 600 may also include an input device 632. In one example, a user of computer system 600 may enter commands and/or other information into computer system 600 via input device 632. Examples of an input device 632 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. Input device 632 may be interfaced to bus 612 via any of a variety of interfaces (not shown) including, but not limited to, a serial interface, a parallel interface, a game port, a USB interface, a FIREWIRE interface, a direct interface to bus 612, and any combinations thereof. Input device 632 may include a touch screen interface that may be a part of or separate from display 636, discussed further below. Input device 632 may be utilized as a user selection device for selecting one or more graphical representations in a graphical interface as described above.

A user may also input commands and/or other information to computer system 600 via storage device 624 (e.g., a removable disk drive, a flash drive, etc.) and/or network interface device 640. A network interface device, such as network interface device 640, may be utilized for connecting computer system 600 to one or more of a variety of networks, such as network 644, and one or more remote devices 648 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 644, may employ a wired and/or a wireless mode of communication. In general, any network topology may be used. Information (e.g., data, software 620, etc.) may be communicated to and/or from computer system 600 via network interface device 640.

Computer system 600 may further include a video display adapter 562 for communicating a displayable image to a display device, such as display device 636. Examples of a display device include, but are not limited to, a liquid crystal display (LCD), a cathode ray tube (CRT), a plasma display, a light emitting diode (LED) display, and any combinations thereof. Display adapter 562 and display device 636 may be utilized in combination with processor 604 to provide graphical representations of aspects of the present disclosure. In addition to a display device, computer system 600 may include one or more other peripheral output devices including, but not limited to, an audio speaker, a printer, and any combinations thereof. Such peripheral output devices may be connected to bus 612 via a peripheral interface 656. Examples of a peripheral interface include, but are not limited to, a serial port, a USB connection, a FIREWIRE connection, a parallel connection, and any combinations thereof.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and software according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. An electric watercraft comprising:

at least an electric propulsor configured to propel the electric watercraft in a fluid;

a plurality of battery packs located beneath a deck of the electric watercraft and configured to power the at least an electric propulsor;

at least a drainage system configured to drain fluid from the deck, wherein the at least a drainage system further comprises:

at least a drainage path having a drainage path inlet and a drainage path outlet;

at least an active drainage configured to:

receive at least an activation signal; and pump a flow of fluid within the drainage path as a function of the at least an activation signal;

at least a sensor configured to:

detect a fluid parameter on the electric watercraft; and generate the activation signal as a function of the fluid parameter; and at least a controller communicatively connected to a user interface, wherein the at least a controller further configured to:

receive a user input from the user; and control the at least an active drainage as a function of the user input; and wherein the deck and the drainage path inlet are configured to flow fluid from a topside of the deck of the electric watercraft.

2. The electric watercraft of claim 1, wherein the at least a drainage system further comprises:

at least a passive drainage configured to passively direct a flow of fluid from the drainage path inlet to the drainage path outlet when the electric watercraft is stationary.

3. The electric watercraft of claim 1, wherein the at least a drainage path includes a bilge drainage path inlet located within a bilge of the electric watercraft.

4. The electric watercraft of claim 1, wherein the at least a drainage path is configured to avoid electrically sensitive components of the electric watercraft.

5. The electric watercraft of claim 1, wherein the at least an active drainage further comprises at least a pump connected to the at least an electric propulsor and configured to pump a flow of fluid within the drainage path as a function of an operation of the at least an electric propulsor.

6. The electric watercraft of claim 5, the at least a pump comprises an impeller pump configured to propel the electric watercraft and connected to the at least a drainage path as a function of a venturi pump configuration.

7. The electric watercraft of claim 1, wherein the at least an active drainage further comprises a dedicated drain pump operably connected to a dedicated motor and configured to pump a flow of fluid within the drainage path.

8. The electric watercraft of claim 1, wherein the at least a controller is communicatively connected to the at least a sensor of the active drainage, and the controller further configured to:

receive the fluid parameter from the at least a sensor; and display, using the user interface, a drainage system status as a function of the fluid parameter.

9. A method for drainage of water from an electric watercraft, wherein the method comprising:

propelling, using at least an electric propulsor, the electric watercraft in a fluid;

powering, using a plurality of battery packs located beneath a deck of the electric watercraft, the at least an electric propulsor;

draining, using at least a drainage system, a fluid from the deck, wherein the at least a drainage system further comprises:

at least a drainage path having a drainage path inlet and a drainage path outlet;

at least an active drainage configured to:

receive at least an activation signal; and pump a flow of fluid within the drainage path as a function of the at least an activation signal;

at least a sensor configured to:

detect a fluid parameter on the electric watercraft; and generate the activation signal as a function of the fluid parameter; and at least a controller communicatively connected to a user interface, wherein the at least a controller further configured to:

receive a user input from the user; and control the at least an active drainage as a function of the user input;

wherein the deck and the drainage path inlet are configured to flow from a topside of the deck of the electric watercraft.

10. The method of claim 9, wherein the at least a drainage system further comprises:

at least a passive drainage configured to passively direct a flow of fluid from the drainage path inlet to the drainage path outlet when the electric watercraft is stationary.

11. The method of claim 9, wherein the at least a drainage path includes a bilge drainage path inlet located within a bilge of the electric watercraft.

12. The method of claim 9, wherein the at least a drainage path is configured to avoid electrically sensitive components of the electric watercraft.

13. The method of claim 9, wherein the at least an active drainage further comprises at least a pump connected to the at least an electric propulsor and configured to pump a flow of fluid within the drainage path as a function of an operation of the at least an electric propulsor.

14. The method of claim 13, the at least a pump comprises an impeller pump configured connect to the at least a drainage path as a function of a venturi pump configuration.

15. The method of claim 9, wherein the at least an active drainage further comprises a dedicated drain pump operably connected to a dedicated motor and configured to pump a flow of fluid within the drainage path.

16. The method of claim 9, wherein the at least a controller is communicatively connected to the at least a sensor of the active drainage, and the controller further configured to:

receive the fluid parameter from the at least a sensor; and display, using the user interface, a drainage system status as a function of the fluid parameter.

* * * * *